United States Patent [19]

Narasimhan

[11] Patent Number: 4,783,983

[45] Date of Patent: Nov. 15, 1988

[54] METHOD AND APPARATUS FOR AMORPHOUS METAL SLITTING

[76] Inventor: Mandayam Narasimhan, 6 Summit Trail, Flemington, N.J. 08822

[21] Appl. No.: 929,521

[22] Filed: Nov. 12, 1986

[51] Int. Cl.[4] ..... B21B 3/00; B21B 9/00; B26D 7/10; B26D 7/18

[52] U.S. Cl. ..... 72/204; 72/38; 83/101; 83/171; 225/93.5

[58] Field of Search ..... 72/204, 203, 38; 83/170, 171, 101; 202/93.5

[56] References Cited

U.S. PATENT DOCUMENTS

| | | | |
|---|---|---|---|
| 3,865,673 | 2/1975 | DeTorre . | |
| 4,161,898 | 7/1979 | Wingen | 83/171 |
| 4,328,411 | 5/1982 | Haller et al. | 225/93.5 X |
| 4,366,736 | 1/1983 | Oosaki | 83/101 |
| 4,527,613 | 7/1985 | Bedell et al. | 164/463 |
| 4,549,679 | 10/1985 | Watson | 225/2 |
| 4,670,636 | 6/1987 | Taub et al. | 225/93.5 X |

FOREIGN PATENT DOCUMENTS

| | | | |
|---|---|---|---|
| 57170 | 5/1978 | Japan | 83/170 |
| 0030002 | 3/1981 | Japan | 72/204 |

*Primary Examiner*—Robert L. Spruill
*Assistant Examiner*—Steven B. Katz
*Attorney, Agent, or Firm*—King and Schickli

[57] ABSTRACT

A method and apparatus are provided for continuously slitting amorphous ribbon into a strip without adversely affecting the unique electrical, mechanical and magnetic properties of the material. The method includes the steps of heating a localized zone to approximately the glass transformation temperature and substantially simultaneously indenting the ribbon. The combined heating and indenting force produces a clean, high quality cut edge along the strip. Preferably, the positive engaging force causing indentation is effective to plow softened material to form a crystallized ridge adjacent the cut edge. The ridge is easily removed by a rotating brush. The indenter roller preferably includes a substantially V-shaped peripheral edge to concentrate the heat and force against the ribbon. A control unit is employed to provide the optimum heat, force and speed of relative movement between the indenter and the ribbon.

20 Claims, 2 Drawing Sheets

Fig. 2
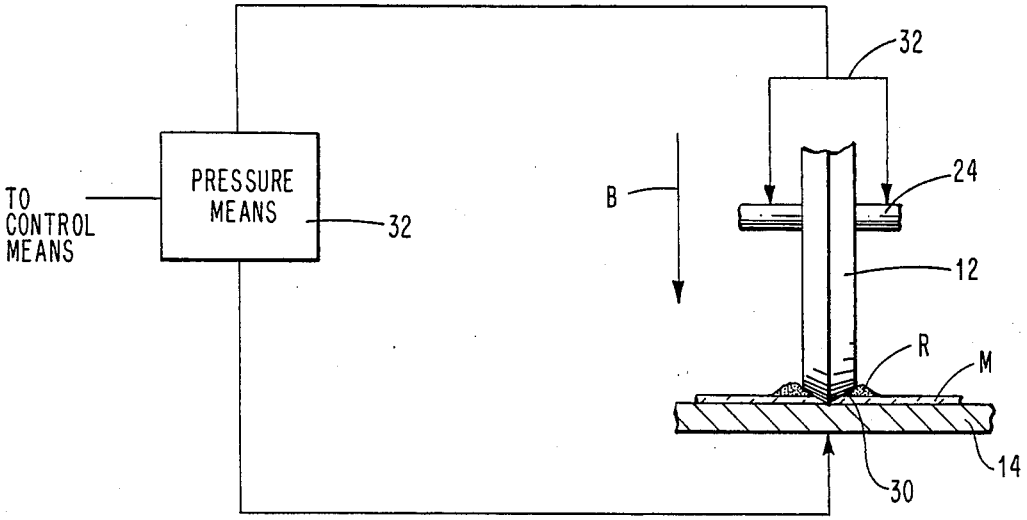
Fig. 3
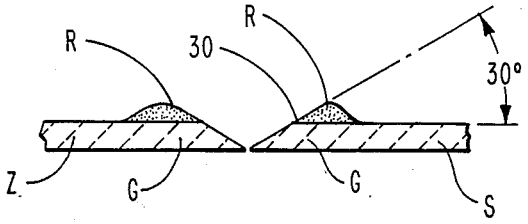
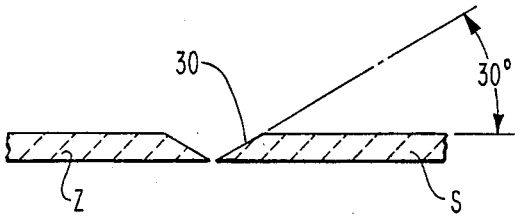
Fig. 4

METHOD AND APPARATUS FOR AMORPHOUS METAL SLITTING

TECHNICAL FIELD

The present invention relates generally to the metal working field and, more particularly, to an apparatus and method for cleanly slitting solid amorphous metal, such as a cast strip or ribbon, while maintaining the electrical, mechanical and magnetic properties of the material even adjacent the slit edges.

BACKGROUND OF THE INVENTION

As is well known in the art, glassy metal alloys are rapidly quenched or cooled at a rate on the order of $10^{6°}$ C. per second from a liquid state to a substantially amorphous solid state. The cast ribbon is typically formed by extruding molten alloy from a pressurized reservoir through a restricted orifice of a nozzle onto a high-speed cooling surface. The cast ribbons are necessarily thin (i.e. up to only approximately 2 mils thick) due to the extreme heat transfer requirements for preventing substantial crystallization.

Glassy or amorphous metal alloys produced in this manner are of considerable technological interest. Specifically, such alloys exhibit unique electrical and magnetic properties that allow the production of, for example, electrical transformers and motors of markedly improved efficiency.

Wound cores and flat laminations can be produced from the ribbons in a nearly unlimited variety of dimensions (width/thickness) as required to meet specific applications. While ribbons of virtually any controlled width may be cast, market volume for a particular width of ribbon may not be sufficient to cover costs for setting up for direct production each time.

Further, ribbons cast to a particular width dimension can suffer from edge burrs, voids and pockets due to molten metal interaction with boundary layer air and/or dirt and contaminants on the surface of the chill substrate adjacent the lateral edges, as well as on the walls of the casting nozzle or on nozzle dividing elements. Disadvantageously, uneven, burred edges can reduce ribbon packing densities and thereby adversely affect the performance of the electrical machinery having components made from the ribbon. Thus, it is clear that a need exists for a method of cleanly slitting and/or trimming- wide ribbons or sheets of amorphous material into strips of desired width for further processing into electrical components and the like.

A number of ribbon cutting or slitting processes have been provided in the past. These include die punching and laser cutting operations. While each of these processes is capable of slitting the cast amorphous ribbon, they are not without their disadvantages.

Since metallic glass alloys have a high hardness (greater than Rockwell 62) and require high stresses to initiate plastic deformation, the punching operation is difficult. Further, the dies in the punching process wear rapidly resulting in approximately 1/100 to 1/1000 the normal service life. In addition, some economical metals, such as Fe-B, Fe-B-Si-C amorphous alloys, are brittle in thicknesses greater than 1 mils and therefore are subject to crack formation and breaking during punching. When the punched strips of amorphous metal are annealed at the Curie point to enhance magnetic properties, they are also subject to a loss of ductility. As a result, any cracks left from the punching process can act as stress risers when the laminations are put together. This, of course, leads to shattering from edge cracks and premature failure.

Laser cutting processes do avoid many of the problems noted above with respect to punching operations but, unfortunately, they also suffer from their own inherent drawbacks. In laser cutting a high energy beam creates a high temperature spot on the amorphous metal material that melts and separates the material into strips of the desired width. As the amorphous material is heated, however, a greater portion of the laser beam is reflected. As a result, it is difficult to maintain controlled power delivery to the cutting region. Consequently, through overcompensation and an increase in power, the amorphous structure may be lost adjacent the cut edge through the recrystallization of the strip material. In addition, cutting speeds using lasers are relatively slow and therefore not cost efficient for processing.

With a background of these difficulties, others skilled in the art have been lead in another direction to still another technique; that is, slitting by producing a controlled disturbance in the molten puddle of the cast ribbon. This technique is described and claimed in U.S. Pat. No. 4,527,613, issued July 9, 1985 and assigned to Electric Power Research Institute. While this process is generally successful for its intended purpose, it is of course limited to having to be carried out during the initial casting process before solidification into an amorphous ribbon. In several respects this procedure is less desirable. For example, it is more economical to cast and stock the ribbon in a universal width and then cut or trim to the width needed, when needed.

A need is, therefore, identified for a new and improved method and apparatus for cutting or slitting solidified amorphous metal ribbon while maintaining the desirable electrical, mechanical and magnetic properties of the material.

SUMMARY OF THE INVENTION

Accordingly, it is a primary object of the present invention to provide an improved method and apparatus for slitting amorphous metal ribbon in solidified form overcoming the above-described limitations and disadvantages of the prior art.

An additional object of the present invention is to provide an apparatus and a method for the relatively rapid slitting of amorphous metal ribbon into strips of desired width wherein the electrical, mechanical and magnetic properties of the material are maintained even adjacent the cut edges.

Another object of the present invention is the provision of an amorphous metal slitting apparatus and method allowing the clear slitting along a ribbon without introducing excessive brittleness due to heating or cracks at the cut edges.

A further object of the present invention is to provide an apparatus and method for slitting amorphous metal ribbon into strips having clean, high-quality edges and a substantially continuous amorphous structure throughout.

Still another object of this invention is to provide an amorphous metal ribbon slitting apparatus and method that leave the cut edges free of burrs or deformations so as to allow subsequent stacking of the cut strips into high-density, high-efficiency transformer cores, motor windings and other laminations.

To achieve the foregoing and other objects, and in accordance with the purposes of the present invention as described herein, an improved method is provided for continuously slitting solid amorphous metal strips, ribbons or the like into narrower strips of the exact desired width.

The method includes the step of heating a localized zone of the amorphous metal ribbon approximately 0.01 inch wide to a temperature near the glass transformation temperature for the alloy. The invention takes advantage of the excellent flow properties of the material at these temperatures by substantially, simultaneously indenting the material along the zone as the material softens from heating. The indentation is performed with sufficient localized force to provide a slitting action of the ribbon. Continuous slitting is provided by moving the amorphous material relative to the indenter.

More specifically, the softened, indented ribbon is subjected to high temperature plastic deformation and plowed by an indenter roller. In effect, the excess material from the slitting action is plowed to the side, flows up and forms a ridge or bulb adjacent the cut edges. The heat is preferably applied directly through the roller. Immediately after the roller has cleared the slitting zone, the plowed material is rapidly cooled and is displaced upwardly so that it crystallizes and becomes brittle. The crystallized ridge is then easily removed as, for example, by brush rollers and underneath clean, amorphous edges of the slit strips are revealed.

While an indenter roller is the preferred embodiment, a stylus having a tip in engagement with the ribbon may be employed to form the indenter means, in accordance with broader aspects of the invention. Whereas rolling contact is believed to be best at present, when a stylus is used, the ribbon is simply dragged relative to it. In either case, a positive engaging force is applied between the indenter means and the substrate upon which the ribbon is positioned.

Advantageously, the favorable magnetic saturation, eddy current, hysteresis, and mechanical characteristics of the amorphous material are maintained substantially unaltered throughout the cut strips. This is true even adjacent the edges. Since only localized heating is used to effect slitting, excessive brittleness due to heating is avoided. Further, the cut edges are cleaner and of higher quality. Thus, problems relating to the introduction of cracks at the cut edges are substantially eliminated and high packing densities in cores and laminations are also possible.

Preferably, the method includes the additional concept of providing the positive engaging force by downward pressure directly through the indenter roller to slit the amorphous material. Typically, an engaging force of approximately 50 grams is applied to the indenter roller. The heating of the material is produced by establishing an electric voltage across the ribbon between the indenter roller and a support plate forming a portion of the support substrate of the slitting apparatus. The voltage is preferably selected to be between approximately 3 and 20 volts. Due to the high thermal efficiency of the process, for a typical amorphous alloy a high quality slitting action can be effected by passing 5–10 amps at 5 volts through the ribbon.

The relative moving rate between the amorphous metal ribbon and the indenter may vary for different amorphous alloys, but is preferably approximately 12" per second. With positive force on the indenter roller being maintained at a preferred approximately 50 grams this relative rate of movement is ideal. These parameters produce the appropriate heating and simultaneous plowing of the amorphous ribbon for the most efficient slitting action. By adjusting the electric voltage/current level across the ribbon, the material in the slitting zone can be efficiently heated to the glass transformation temperature, typically found to be between 350° and 450° C. for the most useful amorphous alloys.

In accordance with a further aspect of the present invention, an apparatus is provided for cleanly slitting solid amorphous metal ribbon. The apparatus includes a substrate or support plate and an indenter for slitting the amorphous ribbon on the substrate. Means are also provided for heating the indenter to soften the amorphous ribbon. In addition, the apparatus includes means for pressing the indenter against the substrate to produce the desired positive engaging force against the ribbon. Preferably, where a continuous straight-line slit is required, the indenter is in the form of a roller.

The roller includes a V-shaped, peripheral edge that serves to concentrate force and localize the heat for cutting in the required narrow slitting zone. Advantageously, the heated amorphous ribbon adjacent the cut edges is quickly quenched by the two resulting strips that are relatively cool. This heat sink effect helps retain the substantially amorphous character of the ribbon at the edges except for the plowed ridges. Each side of the peripheral edge of the roller extends at an approximately 30° included angle with respect to the horizontal. Such a configuration provides the optimum plow action and rapid cooling that allows the cutting of clean, deformation-free edges in accordance with the invention.

In accordance with another aspect of the invention, when the indenter is a stylus, it may specifically take the form of a graphite electrode with a conical tip. This stylus arrangement is especially useful where complex edge patterns need to be cut; i.e. multi-axis movement of the indenter relative to the amorphous material is required.

A control unit, such as a microprocessor, provides individual control of the heating and pressing of the indenter roller with the desired force, as well as the relative speed of movement between the indenter roller and the amorphous ribbon. More specifically, the microprocessor is designed to manipulate these parameters to provide the desired slitting action. The heating is controlled by a rheostat or variable resistor. This resistor allows adjustment of the current flow through the indenter roller.

In order to prevent oxidation of the indenter roller and increase the overall service life of the apparatus, a shield is provided around the upper portion of the roller. A pump supplies inert gas to the shield so as to envelope the indenter roller and flood the slitting zone during the high temperature cutting operations.

Still other objects of the present invention will become readily apparent to those skilled in this art from the following description wherein there is shown and described a preferred embodiment of this invention, simply by way of illustration of one of the modes best suited to carry out the invention. As it will be realized, the invention is capable of other different embodiments and its several details are capable of modifications in various, obvious aspects, all without departing from the invention. Accordingly, the drawing and descriptions will be regarded as illustrative in nature and not as restrictive.

BRIEF DESCRIPTION OF THE DRAWING

The accompanying drawing incorporated in and forming a part of the specification illustrates several aspects of the present invention, and together with the description, serves to explain the principles of the invention. In the drawing:

FIG. 2 is a partial, transverse cross-sectional view, also with a portion in schematic form, providing a head-on view of the slitting action of the amorphous material by the indenter roller;

FIG. 3 is a transverse cross-sectional view showing the amorphous ribbon immediately following slitting with the indenter, roller; and FIG. 4 is an additional cross-sectional view showing the amorphous ribbon following removal of the bulb or ridge created during slitting by the indenter roller.

Figure 1:
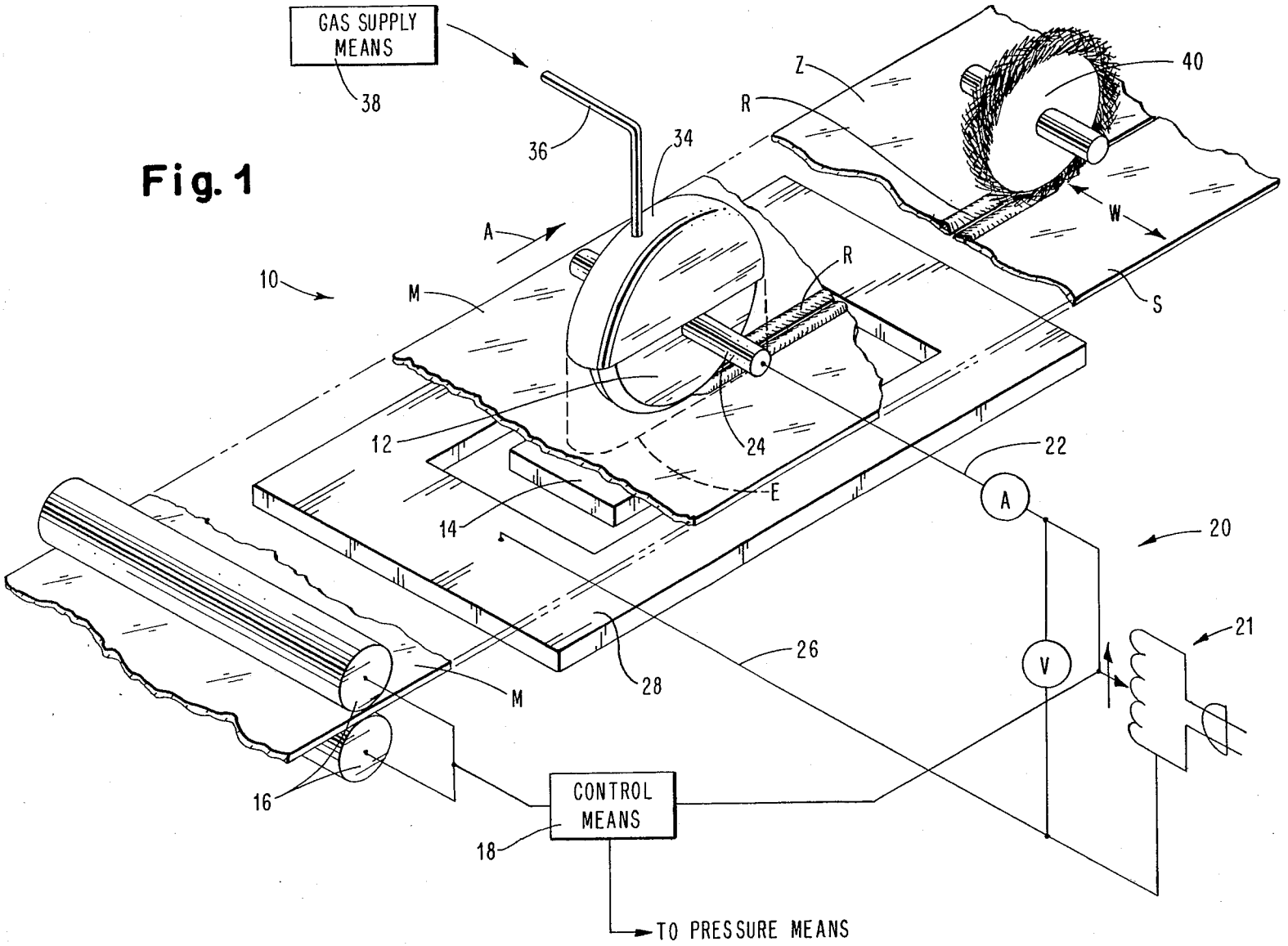
FIG. 1 is a partially schematic, perspective view of the amorphous metal ribbon slitting apparatus of the present invention.

Reference will now be made in detail to the present preferred embodiment of the invention, an example of which is illustrated in the accompanying drawing.

DETAILED DESCRIPTION OF THE INVENTION

Reference is now made to FIG. 1, depicting an improved method and showing a related apparatus 10 for cleanly slitting solid amorphous ribbon into strips of desired reduced width for subsequent processing into electrical motor laminations and transformer cores or the like. Advantageously, in addition to providing clean cut edges, the amorphous structure, as well as the electrical, mechanical and magnetic properties characteristic thereof, is maintained even in the edge area following slitting or cutting.

As shown, the slitting apparatus 10 includes an indenter roller 12 for heating and slitting the amorphous ribbon M during continuous movement against a substrate or support 14 in the direction of action arrow A. The feeding action may be by driven feed rolls 16 upstream and/or downstream of the slitting zone.

A control means 18, such as a microprocessor, is provided for controlling the feed rate of the amorphous ribbon M relative to the indenter roller 12. The control means 18 also controls and automatically adjusts the heating of the indenter roller 12, as well as the engaging force of the indenter roller 12 against the ribbon M. The accurate control of these parameters helps provide the desired smooth slitting action of the present inventive concept.

The heating of the indenter roller 12 is generated through an electrical circuit, generally designated by reference numeral 20. As shown, the circuit 20 includes a variable resistor 21 for adjusting the current being applied to the roller 12 through electrical line 22 and roller shaft 24. The line 26 and platform 28, forming a portion of the support substrate, along which the ribbon M is fed for slitting, forms the remainder of the circuit 20. As illustrated, the control means 18 is directly connected to the variable resistor 21 to allow constant adjustment as may be required to maintain the optimum slitting action.

The applied voltage established across the ribbon M between the indenter roller 12 and the platform 28 is typically between 3 and 20 volts. It has been found that passing of a current of approximately 5–10 amps at 5 volts through the ribbon M produces a high quality slitting action for a typical amorphous alloy ribbon.

The indenter roller 12 is preferably formed of graphite or other high strength composite material for high conductivity and long service life at the high temperatures. As best shown in FIG. 2, the roller 12 includes a substantially V-shaped peripheral edge 30 to concentrate the heat created by the flow of current at the interface with the amorphous ribbon M. Preferably, the sides of the Y-shaped edge 30 are each at an included angle of approximately 30° with respect to the horizontal. This application of a sharp edge with the necessary vertical loading to the ribbon M provides the optimum slitting action. This angle also provides the desired plowing action to cause high temperature plastic deformation to raise a ridge R of crystallized alloy on each of the strips S.

Indenter roller 12 is provided with a positive engaging force, that is, vertically loaded, with a force in the direction of action arrow B by a pressure means, schematically shown in FIG. 2 at reference numeral 32. The pressure means 32 thus presses the roller 12 against the ribbon M supported on the support substrate 14 and the platform 28. The pressure means 32 is constructed in accordance with teachings known in the art and may, for example, utilize fluid actuator cylinders (not shown). A vertical loading force of approximately 50 grams is contemplated as the norm to produce the desired slitting within the voltage and current settings discussed above.

A hooded shield 34 is provided around the upper portion of the indenter roller 12 as a safety measure and to prevent the loss of excessive heat (note FIG. 1). Inert gas may be passed into the shield 34 through line 36 from a supply means 38, such as a high pressure nitrogen gas cylinder. The inert gas is expelled from the shield 34 to form an envelope E around the slitting zone. This envelope E protects the roller 12, as well as the ribbon M in the slitting zone from contact with the air thereby preventing oxidation. This avoids deterioration of the roller during high temperature slitting operations and provides improved metal working conditions in the slitting zone, further enhancing the quality of the edges 30 produced.

The slitting apparatus 10 also includes a brush roller 40 downstream from the indenter roller 12. The brush roller 40 serves to remove the crystallized ridge R of plowed material formed adjacent the edges 30 during slitting.

The apparatus 10 of the present invention thus efficiently slits the amorphous ribbon M to produce a strip S of reduced width W and a remainder strip section Z. If carried out in accordance with the method and the parameters identified, the separated edges 30 are smooth and substantially free of crystalline structure. The rapid cooling by the heat flowing from the edges 30 into the strip S and the remainder section Z of the ribbon is effective to maintain the amorphous character of the metal alloy, as desired. The control means 18 can be adjusted to the optimum feed rate, pressure and heating parameters of the system to produce smooth, clean cuts without damaging the amorphous structure and associated properties of the ribbon.

In operation, the feed rolls 16 feed the amorphous ribbon M across the support substrate 14 longitudinally into engagement with the indenter roller 12. As the ribbon M contacts the wheel 12 in operating position, the electrical circuit 20 is completed. When current begins to flow through the roller 12 and ribbon M, the result is the resistance heating of the roller edge 30. A localized zone is defined wherein the ribbon M is softened. During the "start-up" time when the roller 12 first heats to operating temperature, the ribbon M is not completely slit and processed. It should be appreciated, however, that this "start-up" time is of very short duration, and that once operating temperature is reached, clean slitting action is continuously provided. The optimum width of the localized slitting zone, that is, the space across the edges 30, is approximately 0.01 inch.

The amorphous alloy ribbon M is fed continuously past the indenter roller 12 at a rate of approximately 12" per second. The concentrated heating produced by the V-shaped edge 30 of the indenter roller 12 heats only the ribbon M in the narrow, localized slitting zone adjacent the roller edge to or near the glass transformation temperature, (i.e. approximately 350° to 450° C.). To accomplish this temperature level of the ribbon, the roller 12 is heated to approximately 800° C. Substantially simultaneously with heating, the positive engaging force on the roller 12 created by the pressure means 32 produces a plowing action of the softened material in the slitting zone. The support substrate 14 is preferably constructed of fused silica, alumina, or other material of low thermal conductivity. Thus, the substrate 14 removes minimum heat from the lower face of the amorphous ribbon thereby assuring sufficient softening for complete and smooth slitting with high edge definition.

As shown in FIGS. 1–3, the ribbon material that softens from heating flows up under the pressure of the indenter roller 12 into a ridge R of displaced material as the strip S is separated from the remainder strip section Z. This displaced ridge R which is actually raised upwardly by simple plastic deformation of the metal alloy that naturally occurs at or near the glass transformation temperature, then crystallizes as it cools and becomes brittle relative to the rest of the strip S. In fact, the ridge R is so brittle relative to the underlying angled margin G of the strip S (see FIG. 3, underneath and adjacent the cut edge 30) that said ridge R essentially drops off the strip S with little additional processing.

A preferred manner of assuring removal of the ridge 30 is with a rotary brush roller 40. All that is required is to lightly engage the brittle ridge R, knocking it from the strip S. Advantageously, this procedure is effective in producing the clean, high quality cut edge desired (see FIG. 4).

In summary, it should now be clear that substantial benefits result from employing the concepts of the present invention for continuously slitting amorphous ribbon M into a desired width, such as the strip S. The heated indenter roller 12 is pressed against the ribbon R raising the temperature to approximately the glass transformation level, and thereby is effective to plow the softened material in the localized zone. Upon continuous relative movement between the ribbon R and the substrate 14, the slitting of the ribbon is effected. The heat adjacent the slit is rapidly dissipated into the ribbon M by the heat sink effect to maintain the amorphous structure. The plowing action of the V-shaped edge of the roller produces a ridge R along the separated strip that crystallizes and becomes brittle. A rotating brush roller 40 is advantageously utilized to remove the ridge R. The smooth margin and edge definition of the strip S is maintained and there is no undesired alteration of the electrical, mechanical and magnetic properties. Cracks in the edges, curling, burrs and/or other deformations along the edges are substantially eliminated. As a result, packing of ribbons to form laminations of desired width without deleterious voids, from which highly efficient transformer cores and related products may be constructed is now possible. Of additional significance, this advantageous result can be obtained from amorphous alloy ribbon previously cast in standard widths for greater production economy.

The foregoing description of the preferred embodiment of the invention has been presented for purposes of illustration and description. It is not intended to be exhaustive or to limit the invention to the precise form disclosed. Obvious modifications or variations are possible in light of the above teachings. For example, the indenter roller 12 may be replaced by a stylus including a conical tip which is dragged relative the amorphous ribbon M. This alternative embodiment is especially useful where complex slitting patterns that include transverse movement with respect to the ribbon are required; i.e. where complex ribbon edge patterns are desired. Also, two or more indenter rollers or styli could be used at once to process wide amorphous materials into several strips S. Thus, it is clear that the preferred embodiment is chosen and described to provide the best illustration of the principles of the invention and its practical application set forth to thereby enable one of ordinary skill in the art to utilize the invention in various embodiments and with various modifications as are suited to the particular use contemplated. All such modifications and variations are within the scope of the invention as determined by the appended claims when interpreted in accordance with the breadth to which they are fairly, legally, and equitably entitled.

I claim:

1. A method for continuously slitting solid amorphous metal alloy ribbon into strips of desired reduced width, comprising the steps of:

heating limited to a localized zone of said amorphous ribbon to a temperature, approximating the glass transformation temperature of said alloy;

substantially simultaneously indenting said amorphous ribbon by a positive engaging force with an indenter along said localized zone as material in said localized zone softens;

continuously moving said amorphous ribbon relative to said indenter to provide a line of continuous slitting; and rapidly cooling said strips along the slitting line;

whereby electrical, mechanical and magnetic properties of the slit amorphous ribbon are maintained and clean, high-quality cut edges are obtained.

2. The method of claim 1, wherein said indenting step includes the step of plowing said softened material in said localized zone so as to form a ridge of displaced material adjacent said cut edge through high temperature plastic deformation of the alloy.

3. The method of claim 2 including the additional step of removing said ridge of displaced material adjacent said cut edge after said displaced material crystallizes and becomes brittle.

4. The method of claim 1 including the step of providing sufficient positive engaging force between said indenter and the substrate on which amorphous ribbon is positioned so as to provide a localized slitting zone in said ribbon of approximately 0.01 inch.

5. The method of claim 1, wherein said heating step includes the step of establishing an electric voltage across the ribbon between the indenter and a substrate on which the ribbon is supported.

6. The method of claim 5, wherein said voltage is between approximately 3 and 20 volts.

7. The method of claim 6, including the additional step of passing a current of between 5 and 10 amps through said ribbon at approximately 5 volts.

8. The method of claim 1, wherein said relative moving rate between said amorphous ribbon and said indenter is approximately 12 inches/second.

9. The method of claim 4, wherein said force is approximately 50 grams.

10. The method of claim 1, wherein said transformation temperature is between 350° and 450° C.

11. An apparatus for continuously slitting solid amorphous metal alloy ribbon into strips of desired reduced width comprising:

substrate means for supporting said ribbon;

means for substantially simultaneously effecting localized heating and slitting of said ribbon on said substrate means including indenter means for slitting said ribbon, means for heating said indenter means, and means for pressing said indenter means and said substrate means together with a positive engaging force; and means for continuously moving said amorphous ribbon relative to said indenter means to provide a line of continuous slitting; said indenter means being effective to limit the heating of the ribbon in a localized zone to approximately the glass transformation temperature for softening the ribbon and substantially simultaneously providing sufficient force to thereby cause the slitting of the ribbon, whereby electrical, mechanical and magnetic properties of the slit amorphous strips are maintained and clean, high-quality cut edges are obtained.

12. The slitting apparatus of claim 21 wherein said indenter means is shaped to plow said softened material by high temperature plastic deformation so as to form a ridge of displaced material adjacent the cut edges of said amorphous ribbon;

and wherein is further provided means for removing said ridge of displaced material following crystallization to provide clean, high quality cut edges.

13. The slitting apparatus of claim 12, wherein said indenter means is a roller including a V-shaped peripheral edge for localizing the heat and providing the plowing action for slitting.

14. The slitting apparatus of claim 13, wherein each side of said V-shaped peripheral edge extends at an included angle of approximately 30° with respect to the horizontal.

15. The slitting apparatus of claim 12, wherein said roller is formed of graphite.

16. The slitting apparatus of claim 11, further including means for controlling the heating and pressing of said indenter means and the relative speed of movement between the indenter means and the ribbon.

17. The slitting apparatus of claim 16, wherein a rheostat is provided for adjusting the current flow through said indenter means.

18. The slitting apparatus of claim 11, wherein a shield is provided around an upper portion of said indenter means.

19. The slitting apparatus of claim 18, wherein means is provided for supplying inert gas into said shield so as to envelope said indenter means and protect said indenter means from oxidation and deterioration.

20. The slitting apparatus of claim 11, wherein said localized zone is substantially 0.01 inch wide.

* * * * *